US009289788B2

(12) United States Patent
Beranger et al.

(10) Patent No.: US 9,289,788 B2
(45) Date of Patent: Mar. 22, 2016

(54) FLUID DISPENSER

(71) Applicant: APTAR FRANCE SAS, Le Neubourg (FR)

(72) Inventors: Stéphane Beranger, Surtauville (FR); Frédéric Duquet, Crespieres (FR)

(73) Assignee: APTAR FRANCE SAS, Le Neubourg (FR)

( * ) Notice: Subject to any disclaimer, the term of this patent is extended or adjusted under 35 U.S.C. 154(b) by 169 days.

(21) Appl. No.: 14/071,748

(22) Filed: Nov. 5, 2013

(65) Prior Publication Data

US 2014/0131392 A1 May 15, 2014

Related U.S. Application Data

(60) Provisional application No. 61/736,766, filed on Dec. 13, 2012.

(30) Foreign Application Priority Data

Nov. 13, 2012 (FR) ..... 12 60781

(51) Int. Cl.

| | |
|---|---|
| ***A46B 11/00*** | (2006.01) |
| ***B05B 11/04*** | (2006.01) |
| ***A45D 34/00*** | (2006.01) |
| ***A45D 34/04*** | (2006.01) |

(52) U.S. Cl.

CPC ..... *B05B 11/048* (2013.01); *A45D 34/00* (2013.01); *A45D 34/04* (2013.01); *A45D 2200/054* (2013.01); *A45D 2200/055* (2013.01); *A45D 2200/056* (2013.01)

(58) Field of Classification Search

CPC ... A45D 34/04; A45D 34/045; A45D 40/265; A45D 2200/054; A45D 2200/055; A45D 2200/056; B05B 11/048

USPC ..... 401/126; 222/305

See application file for complete search history.

(56) References Cited

U.S. PATENT DOCUMENTS

| | | | | |
|---|---|---|---|---|
| 7,494,295 | B2 * | 2/2009 | Delage | 401/130 |
| 2013/0032242 | A1 * | 2/2013 | Beranger et al. | 141/23 |
| 2014/0020789 | A1 * | 1/2014 | Duquet et al. | 141/24 |

FOREIGN PATENT DOCUMENTS

| | | | |
|---|---|---|---|
| FR | 2 727 670 | A | 6/1996 |
| FR | 2924696 | A1 * | 6/2009 |

OTHER PUBLICATIONS

French Search Report for FR 1260781 dated Jul. 12, 2013.

* cited by examiner

*Primary Examiner* — Jennifer C Chiang
(74) *Attorney, Agent, or Firm* — Sughrue Mion, PLLC

(57) ABSTRACT

A fluid dispenser including a fluid reservoir containing fluid; a fluid suction chamber of variable volume including an extraction and application space that varies between a minimum volume and a maximum volume; a dip tube that connects the reservoir to the suction chamber at an orifice; a suction mechanism for sucking, during a suction stage, fluid from the reservoir into the chamber through the orifice; and an extractor and applicator member that defines, in part, the suction chamber and the suction mechanism, and further the extraction and application space; wherein the sliding of the slidable sleeve over the stationary stem does not involve any resilient driving force.

13 Claims, 3 Drawing Sheets

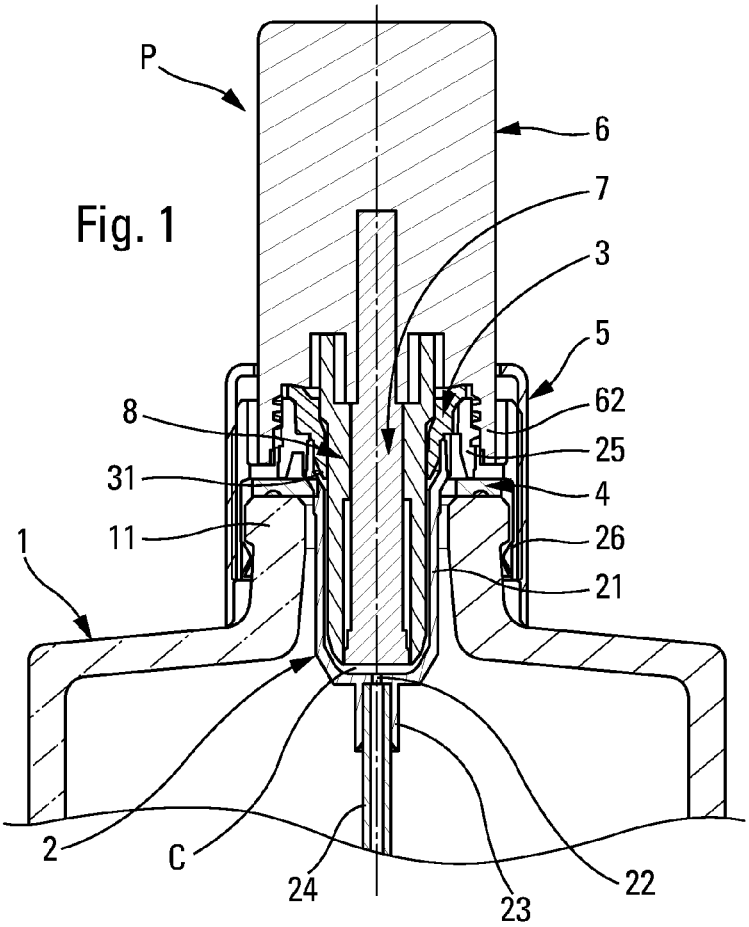
Fig. 1
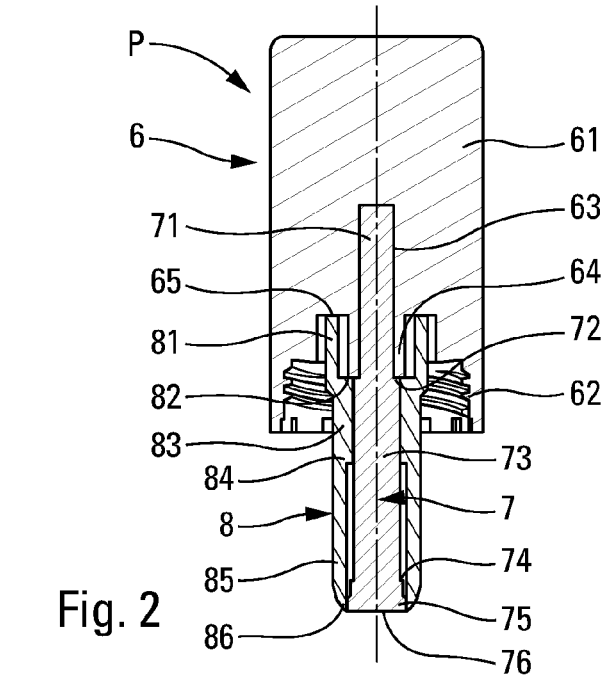
Fig. 2
Fig. 3
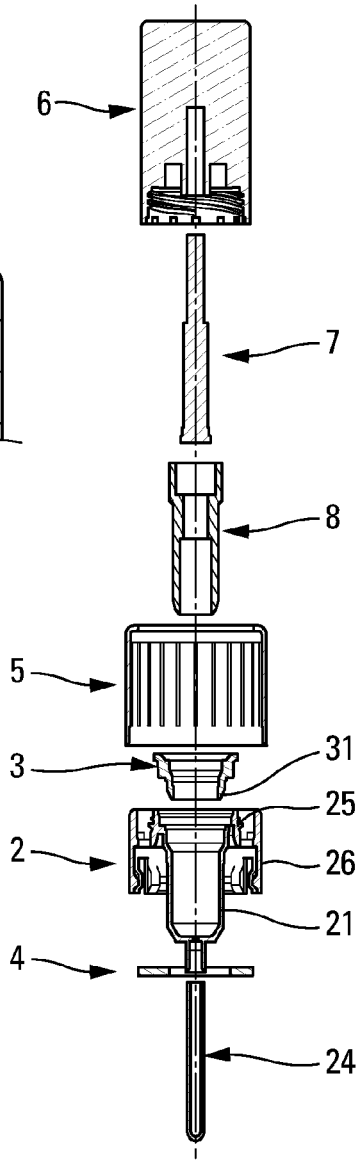

FLUID DISPENSER

CROSS REFERENCE TO RELATED APPLICATION

This application claims the benefit under 35 U.S.C. §119 (e) of U.S. provisional patent application Ser. No. 61/736,766, filed Dec. 13, 2012, and priority under 35 U.S.C. §119 (a)-(d) of French patent application No. FR-12 60781, filed Nov. 13, 2012.

TECHNICAL FIELD

The present invention relates to a fluid dispenser comprising: a fluid reservoir containing fluid; a fluid suction chamber of variable volume comprising an extraction and application space; a dip tube that connects the reservoir to the chamber at an orifice; suction means for sucking, during a suction stage, fluid from the reservoir into the chamber through the orifice; and an extractor and applicator member that defines, in part, the suction chamber and the suction means, the extractor and applicator member defining the extraction and application space. An advantageous field of application of the present invention is the field of perfumery, cosmetics, or even pharmacy.

BACKGROUND OF THE INVENTION

In the prior art, document FR 2 924 696 is already known that describes a dispenser of this type. The operation and the use of that dispenser are relatively simple. The user holds the reservoir with one hand and removes the extractor and applicator member with the other hand, thereby causing fluid in the metering chamber to be sucked through the dip tube connected to the reservoir. Filling the metering chamber also makes it possible to fill the extraction and application space that is secured to the fluid applicator. It should be observed that the volume of the space is fixed and constant: it is not subjected to any deformation or modification. When the fluid applicator is removed completely from the reservoir, it is separate therefrom, the metering chamber is open to the outside, and the extraction space, which is secured to the fluid applicator, may be put into contact with an application surface, such as the skin of the user. The fluid is applied either by successive dabbing contact with the skin, or by moving the extraction zone in contact with the skin. Either way, the fluid stored in the extraction space is transferred progressively by a surface tension phenomenon onto the user's skin.

Naturally, in order to enable such a transfer from the extraction space to the application surface of the user, it is necessary for the fluid to present relatively low viscosity. With a fluid of higher viscosity, such as a cream or a gel, said fluid would remain stuck to the inside walls of the extraction space, such that only a limited portion of the fluid could be applied to the application surface. Consequently, the document FR 2 924 696 dispenser that presents an extraction space of volume that is fixed and constant, is not suitable for dispensing viscous fluids such as creams, gels, pomades, etc.

An object of the present invention is to remedy the above-mentioned drawbacks of the prior-art document by defining a fluid dispenser that is based on the same principle, but that makes it possible to apply a viscous fluid. An object of the present invention is to guarantee both complete filling of the extraction space while the applicator is being removed, and complete emptying of the extraction space while the fluid is being applied to the application surface. Another object of the present invention is to preserve a structure and an architecture of the fluid dispenser that are particularly simple. Still another object of the present invention is to preserve the handling in use of the prior-art fluid dispenser. Still another object of the present invention is to avoid using material that is not recyclable, such as metal.

BRIEF SUMMARY OF THE INVENTION

To achieve the various objects, the present invention proposes a fluid dispenser comprising a fluid reservoir containing fluid, a fluid suction chamber of variable volume comprising an extraction and application space that presents a volume that varies between a minimum volume when the suction chamber presents a minimum volume, and a maximum volume when the suction chamber presents a maximum volume, a dip tube that connects the reservoir to the suction chamber at an orifice, suction means for sucking, during a suction stage, fluid from the reservoir into the chamber through the orifice, and an extractor and applicator member that defines, in part, the suction chamber and the suction means, the extractor and applicator member defining the extraction and application space, wherein the sliding of the slidable sleeve over the stationary stem does not involve any resilient driving force. Thus, the dispenser may be made from an element made of molded plastics material, excluding any metal element. The variation in the volume of the extraction and application space makes it possible firstly to make it easier to fill it by leveraging the suction means, and secondly to empty it progressively as the fluid is applied to the application surface. This does not apply in the above-mentioned prior art document in which the extraction space presents a fixed volume. Due to the absence of resilient driving force on the sleeve, the application of the fluid product, for example on the skin, is carried out without having to overcome an elastic resistance, resulting in a smoother and more pleasant contact with the skin.

Advantageously, the extraction and application space includes an open applicator end that communicates with the remainder of the suction chamber, and a closed end, the open and closed ends being movable relative to each other. The two ends of the extraction and application space may move relative to each other in various ways, such as by sliding like a piston or by a flexible element deforming elastically.

In a practical embodiment, the extractor and applicator member comprises a handle for being gripped by the hand of a user, a stationary stem that is secured to the handle, and a slidable sleeve that is mounted in slidable manner on the stationary stem so as to form the extraction and application space of variable volume. Thus, the stationary stem performs the function of a piston that moves in leaktight manner inside a slide cylinder defined by the slidable sleeve. Advantageously, the slidable sleeve forms the open applicator end of the extraction and application space, and the stationary stem forms the closed end of the extraction and application space. The open applicator end of the sleeve may be in the form of an annular edge for coming into contact with the application surface, while the closed end of the space may be in the form of the free end of the stationary stem that presents a periphery corresponding to the periphery of the open applicator end.

In another aspect of the invention, the slidable sleeve also slides in a stationary lip that is secured to the reservoir so as to define the suction means. Thus, the slidable sleeve is movable both relative to the stationary stem and relative to the stationary lip of the reservoir. The stationary stem performs the function of a piston inside the sleeve so as to define the extraction and application space, and the slidable sleeve performs the function of a piston by sliding in leaktight manner inside the stationary lip so as to define the suction means and the fluid suction chamber.

According to another advantageous characteristic of the invention, the sleeve slides over the stationary stem with friction forces that are less than the friction forces of the suction means. Thus, when the extractor and applicator member is removed from the reservoir, the slidable sleeve remains stationary relative to the stationary lip, whereas the stationary stem moves inside the slidable sleeve in such a manner as to increase the volume of the extraction and application space. Then, when the extraction and application space has reached its maximum volume, the slidable sleeve starts to slide in the stationary lip in such a manner as to increase the volume of the fluid suction chamber even more. The movement of the slidable sleeve over the stationary stem may be driven by spring means, or, in a variant, the sliding of the slidable sleeve over the stationary stem does not involve any resilient driving force. In the force-free configuration, In another advantageous aspect of the invention, the slidable sleeve is in abutment against the stationary stem when the extraction and application space presents a maximum volume. The abutment between the slidable sleeve and the stationary stem naturally defines the maximum extraction and application volume, but it also marks the beginning of sliding of the slidable sleeve inside the stationary lip that is secured to the reservoir.

According to another advantageous characteristic, the slidable sleeve is in abutment against the stationary stem and/or the handle when the extraction and application space presents a minimum volume. In a method of assembling the dispenser, the slidable sleeve is engaged around the stationary stem before the stationary stem is connected in fixed manner to the handle. Thus, the slidable sleeve cannot be removed in any way from the stationary stem, such that the extractor and applicator member constitutes a captive secured-together entity.

As in the above-mentioned prior art document, the suction chamber is open to the outside when the extractor and applicator member is separated from the reservoir. In addition, the suction chamber comprises a cylinder to which the dip tube is connected, the cylinder being provided with a leaktight sliding lip for co-operating with the extractor and applicator member so as to form the suction means.

The spirit of the invention resides in varying the volume of the extraction and application space not only during its filling stage, but also during the stage of applying the fluid to a desired application surface. To do this, the extraction and application space increases progressively as the fluid is removed from the reservoir, and decreases progressively as the fluid is applied to the desired application surface. The extraction and application space thus acts like a pump chamber that is itself included in a suction chamber connected to the reservoir via a dip tube. The extraction and application space may increase in volume before the remainder of the suction chamber increases in volume, or after the remainder of the suction chamber increases in volume, or simultaneously.

BRIEF DESCRIPTION OF THE DRAWINGS

The invention is described more fully below with reference to the accompanying drawings, which show an embodiment of the invention by way of non-limiting example.

In the figures:

FIG. 1 is a vertical-section view through a fluid dispenser in an embodiment of the invention;

FIG. 2 is a view of the FIG. 1 extractor and applicator member;

FIG. 3 is an exploded vertical section view of the FIG. 1 dispenser, with the exception of the reservoir;

DETAILED DESCRIPTION

Figure 4A:
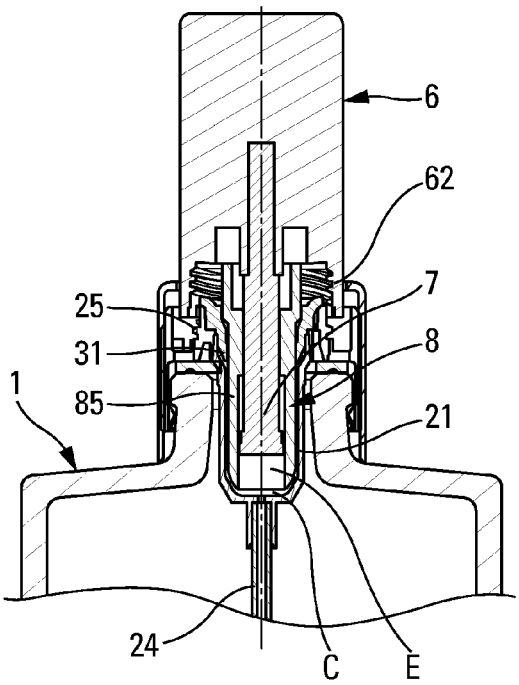
FIGS. 4*a*, 4*b*, 4*c*, and 4*d* show various stages of filling the extraction and application space of the dispenser of the above-mentioned figures.

Reference is made firstly to FIGS. 1 to 3 in order to describe in detail a non-limiting embodiment for a fluid dispenser of the invention. In very general manner, the dispenser comprises a fluid reservoir 1 to which there is associated a dispenser member of the invention. The reservoir 1 is not critical in the present invention, and may thus present characteristics that are very different. It may be made of any material, e.g. glass, plastics, metal, etc., and may present shapes that are very varied. In very conventional manner, the reservoir comprises a voluminous body in which the fluid is stored, and a neck 11 that defines an opening that puts the inside of the body into communication with the outside. The dispenser member of the invention is mounted in stationary and preferably permanent manner on the neck 11 of the reservoir so as to be able to extract the fluid.

The dispenser member of the present invention comprises two very distinct sub-assemblies, namely a first sub-assembly that is secured to the reservoir, and a second sub-assembly that forms an extractor and applicator member P that may be separated from the first sub-assembly. In the embodiment in the figures, the first sub-assembly secured to the reservoir includes a ring 2 that is mounted on and in the neck 11 of the reservoir in stationary, and preferably permanent, leaktight manner. The ring 2 co-operates with a sealing washer 3, a neck gasket 4, and a blocking and covering hoop 5. The four component elements 2, 3, 4, and 5 constitute the first sub-assembly that is mounted in stationary manner on the reservoir 1. The second sub-assembly forming the extractor and applicator member P comprises a handle 6 for being gripped manually by the user, a stationary stem 7 that is secured to the handle 6, and a slidable sleeve 8 that is engaged in movable manner, sliding around the stationary stem 7.

The ring 2 comprises a cylindrical slide cylinder 21 that, at its bottom end, forms an orifice 22 that communicates with a connection sleeve 23 in which a dip tube 24 is engaged. In a variant that is not shown, the dip tube 24 may be made integrally with the connection sleeve 23. At its opposite end, the cylinder 21 is extended by a collar 25 that is externally threaded. Internally, the collar 25 serves as a support for the sealing washer 3 that, at its free bottom end, defines a sealing lip 31 having a function that is explained below. The collar 25 extends radially outwards, forming a disk that is connected to a fastener skirt 26 in engagement with the neck 11 of the reservoir 1. By way of example, the skirt 26 may be made in the form of a plurality of tabs that are separated by slots, each tab forming one or more fastener heads for coming into engagement below an annular reinforcement formed by the neck 11. This characteristic is entirely conventional for fastening a dispenser member on a reservoir neck. In order to hold the fastener skirt 26 in engagement with the neck, it is common practice to use a blocking and covering hoop 5 that is in the form of a cylinder that is engaged around the skirt in clamping manner. Once again, this characteristic is entirely conventional for fastening a skirt around a neck. In this way, the neck gasket 4 is flattened by the ring against the top annular edge of the neck 11. Once again, this characteristic is entirely conventional.

The sealing washer 3 may merely be fitted in the collar 25, or, preferably, the sealing washer 3 may be molded in the collar 25. The sealing washer 3 may be made of an elastomer material so as to impart a certain amount of springiness to the sealing lip 31. Although not shown, it is possible to make the sealing washer 3 integrally with the ring 2. It is also possible to omit the sealing gasket 4. Although not shown, It is also possible to omit the hoop 5 by providing a skirt 26 that, on its own, is strong enough to mount the ring on the neck 11. It is also possible to provide a skirt 26 that co-operates with the inside of the neck 11, and not with the outside as shown in the figures.

When the ring 2 is thus mounted on the neck 11 of the reservoir, the slide cylinder 21 extends inside the neck 11, and the dip tube 24 extends inside the reservoir into the proximity of its bottom wall (not shown). At the opposite end, the cylinder 21 is largely open with its sealing washer 3. The neck can no longer be seen, given that it is masked both by the fastener skirt 26 and by the blocking and covering hoop 5.

The extractor and applicator member P is for co-operating with the first sub-assembly, and in particular with the ring 2 and the sealing washer 3.

The handle 6 defines and a grip appendage 61 that is for being gripped directly by the fingers of the user. The grip appendage 61 may present a wide variety of shapes and is preferably ergonomic so as to make it easier to grip. The handle 6 internally defines a blind borehole 63 that is surrounded in coaxial manner by an annular groove 65. The blind borehole 63 is separated from the annular groove 65 by a small tube 64. At its bottom end, the handle 6 defines an internal thread 62 for co-operating with the threaded collar 25 of the ring 2.

The stationary stem 7 includes an anchor pin 71 that is engaged in stationary and preferably permanent manner inside the blind borehole 63 of the handle 6. The stationary stem 7 also defines a guide section 73 that is connected to the anchor pin 71, forming an annular shoulder 72. In its bottom portion, the guide section 73 forms an abutment 74 and a piston segment 75, and it defines a bottom end 76. It should be observed that the shoulder 72 comes into contact with the free end of the small tube 64 when the anchor pin 71 is engaged fully in the blind borehole 63. The guide section 73 largely projects downwards beyond the internal thread 62 of the handle 6.

The slidable sleeve 8 is engaged around the stationary stem 7, and more precisely around the guide section 73. The slidable sleeve 8 includes an annular base 81 that is engaged inside the annular groove 65. In FIGS. 1 and 2, it can be seen that the annular base 81 even comes into abutment against the end wall of the annular groove 65. Beyond the annular base 81, the slidable sleeve 8 forms an inwardly-directed shoulder 82 that comes into abutment against the free end of the small tube 64. Beyond the inwardly-directed shoulder 82, the slidable sleeve 8 forms a guide segment 83 that slides with little clearance with the guide section 73 of the stationary stem 7. Beyond the guide segment 83, the sleeve 8 forms another shoulder 84 from which the sleeve defines a leaktight-sliding section 85 that is terminated by an open bottom applicator end 86. In FIGS. 1 and 2, it can be seen that the bottom end 76 of the stationary stem 7 is in alignment with the bottom applicator end 86 of the sleeve 8. It should also be observed that the piston segment 75 is in leaktight contact with the inside of the sliding section 85. It can also be seen that the shoulder 84 is at a distance from the abutment 74. In the invention, the slidable sleeve 8 may move by sliding in leaktight manner along the stationary stem 7 between two extreme abutment positions, namely the position shown in FIGS. 1 and 2, and another abutment end that is defined when the shoulder 84 is in abutment against the abutment 74.

It should be observed that the configuration of the handle 6, the stationary stem 7, and the slidable sleeve 8 is such that it is possible to assemble them firstly by engaging the sleeve 8 around the stem 7, and then by engaging the stem 7 in the handle 6. Thus, it is not necessary to put the sleeve 8 into place on the stem 7 by force or by elastic deformation. In addition, the grip and applicator member P constitutes a secured-together unit from which the sleeve 8 can no longer be separated.

In FIG. 1, it can be seen that the extractor and applicator member P is mounted on the ring 2. The thread 62 of the handle 6 is screw-fastened fully on the threaded collar 25 of the ring 2. The slidable sleeve 8 is engaged inside the cylinder 21, defining leaktight annular contact with the sealing lip 31 of the washer 3. Thus, a suction chamber C is formed between the cylinder 21 the sleeve 8 and the stationary stem 7. The suction chamber C communicates with the reservoir 1 through the orifice 22 and the dip tube 24. In FIGS. 1 and 2, the suction chamber C defines a minimum volume. The configuration shown in FIGS. 1 and 2 constitutes the rest and storage position of the dispenser.

Figure 4B:
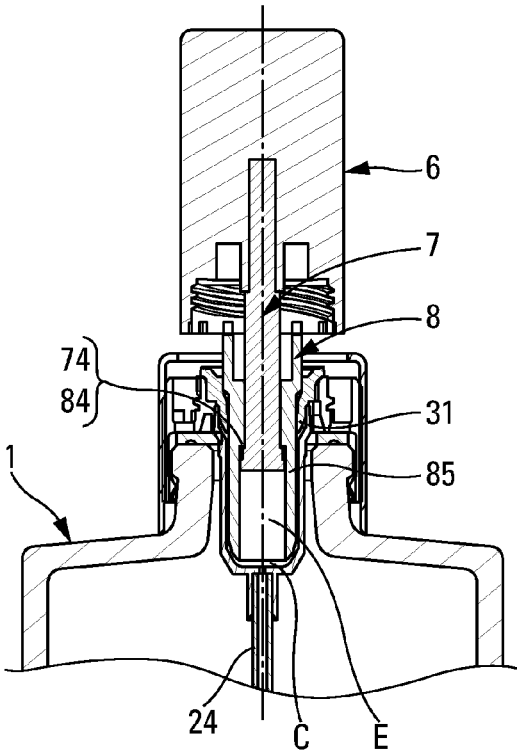
Figure 4C:
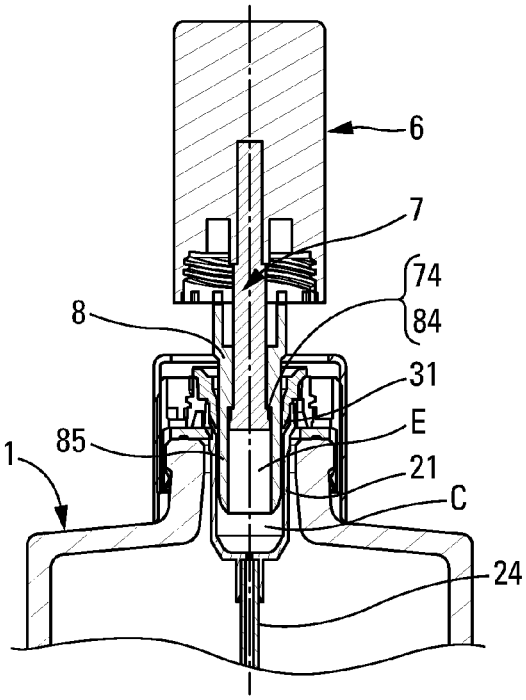
Figure 4D:
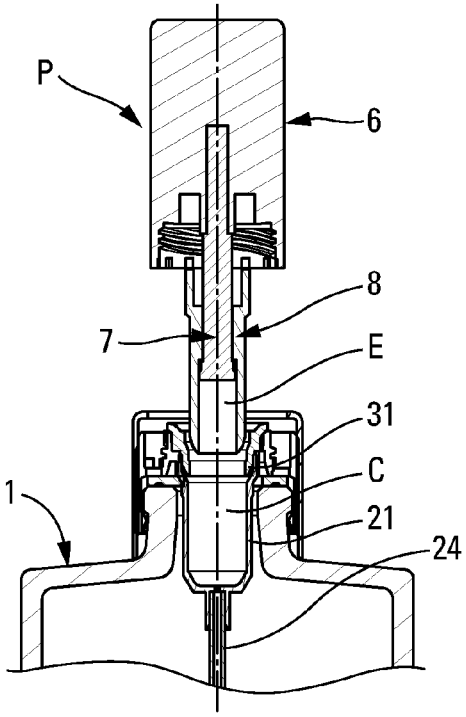

Reference is made below to FIGS. 4*a* to 4*d* in order to describe a first operating cycle of removing the extractor and applicator member P. In FIG. 4*a*, the handle 6 has already been unscrewed from the threaded collar 25, and this has caused a sliding movement in translation between the stationary stem 7 and the slidable sleeve 8. More precisely, the slidable sleeve 8 has remained in place relative to the cylinder 21, while the stationary stem 7 has moved inside the slidable sleeve 8. This is made possible given that the friction forces between the lip 31 and the sleeve 8 are greater than the friction forces between the sleeve 8 and the stationary stem 7. With this relative movement in translation, an extraction and application space E is created inside the sleeve 8 just below the stem 7. The extraction and application space E forms an integral part of the suction chamber C, given that the space E communicates directly with the chamber C at the open applicator end 86 of the sleeve 8. In FIG. 4*b*, the handle 6 has been removed even more, and this has caused an additional increase in the volume of the extraction and application space E. It should be observed that the sleeve 8 is still stationary relative to the cylinder 21. In FIG. 4*b*, the extraction and application space E has reached its maximum volume that corresponds to the shoulder 84 coming into abutment with the abutment 74. From that moment on, any additional traction on the handle 6 will cause the sleeve 8 to slide inside the cylinder 21. This is shown in FIG. 4*c*. Even though the extraction and application space E no longer increases in volume, the suction chamber C increases in volume as a result of the movement of the sleeve 8. The volume of the suction chamber C continues to increase until the bottom end of the sleeve 8 loses contact with the lip 31, and this is shown in FIG. 4*d*. The suction chamber C is then open to the outside. However, the extraction and application space E remains full of fluid by a phenomenon of capillarity, viscosity, and surface tension.

During the increase in volume of the extraction and application space E and of the suction chamber C, fluid from the reservoir is sucked into the space E and the chamber C through the dip tube 24. The co-operation of the sleeve 8 with the sealing lip 31 constitutes suction means that enable the fluid from the reservoir to rise through the dip tube 24. Any kind of fluid may be packaged in the dispenser of the present invention, but an advantageous application is found with viscous fluids such as creams, gels, pomades, etc. The movement of the stem 7 relative to the sleeve 8 makes it possible to vary the volume of the extraction and application space E and to create a pistoning effect that makes it possible to suck the fluid into the space E. Although the volume of the space E is zero in FIG. 1, it increases progressively, as can be seen in FIGS. 4*a* to 4*d* so as to arrive finally at a maximum volume. It can also be said that the extraction and application space E defines an open applicator end that is constituted by the bottom end 86 of the sleeve 8, and a closed end that is constituted by the bottom end 76 of the stem 7. The two ends move relative to each other in such a manner as to vary the volume of the space E.

In other words, the extraction and application space E presents a volume that varies between a minimum volume when the suction chamber C presents a minimum volume, and a maximum volume when the suction chamber C presents a maximum volume.

Figure 5:
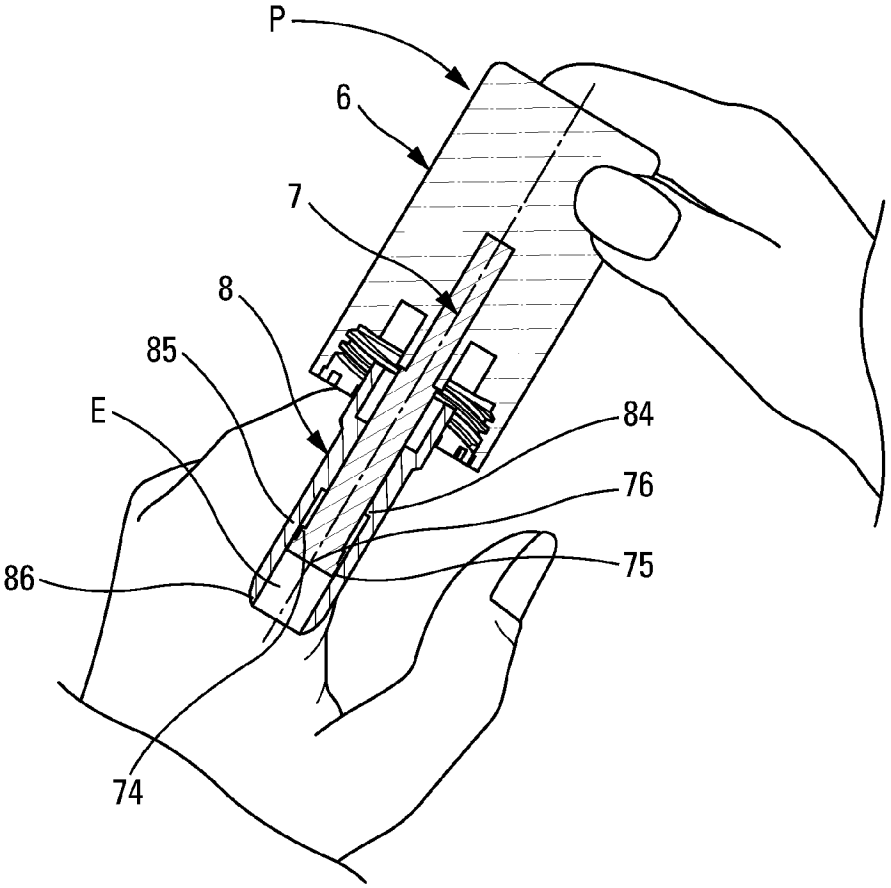
FIG. 5 shows a subsequent stage of applying the fluid to the hand of a user.
Figure 6:
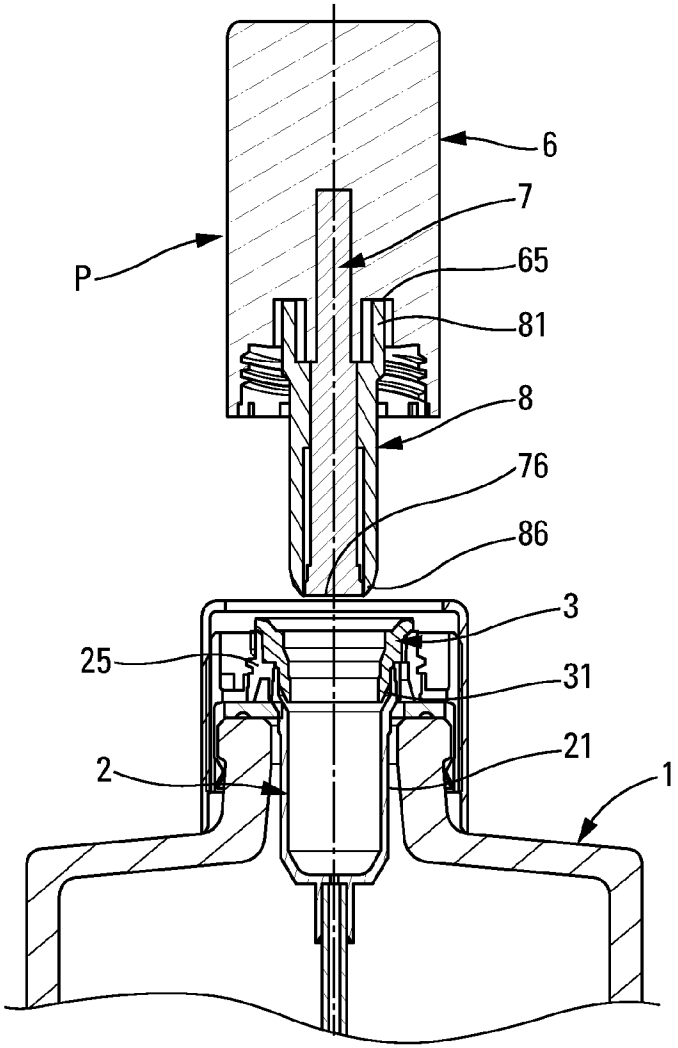
FIG. 6 shows a final stage of repositioning the extractor and applicator member on the fluid reservoir.

Once the extractor and applicator member P is removed from the ring 2, with its extraction and application space E full, the open applicator end 86 of the sleeve 8 may be applied to a desired application surface, e.g. the user's skin. This is shown in FIG. 5. While pressing on the skin, the sleeve 8 moves relative to the stem 7, thereby causing the volume of the space E to decrease. The fluid (cream, gel) that it contains is thus forced out onto the user's skin. The application of the fluid is terminated when the end 76 of the stem is once again in alignment with the open applicator end 86 of the sleeve 8, as shown in FIG. 6. The extractor and applicator member P may then be put back into place in the ring 2, so as to return to the configuration shown in FIG. 1. A complete operating cycle is thus achieved.

It should be observed that the space E increases in volume before the sleeve 8 slides inside the sealing lip 31. This sequential order is defined by the friction values that exist firstly between the sleeve 8 and the lip 31, and secondly between the sleeve 8 and the stem 7. By interchanging the friction values, it would be possible to reverse the sequential order, such that the sleeve 8 would begin to move in the lip 31 before the space E increased in volume. However, in this configuration, it would be necessary to provide means for stopping the sleeve 8 from sliding in the lip 31 before their separation, so as to make it possible for the space E to increase in volume, and for it to be filled, by suction, with fluid from the reservoir. By way of example, it could be envisaged to make the sleeve 8 with an outer shape that is slightly frustoconical, so that the friction forces with the lip 31 increase as said sleeve is removed.

It should also be observed that the sleeve 8 is moved relative to the stem 7 and to the lip 31 without any resilient drive, e.g. generated by a return spring. As a result, the dispenser of the invention may be made without using any metal and provides a soft or smooth contact with the skin.

By means of the invention, a dispenser is obtained including a suction chamber C that defines an extraction and application space E of volume that varies in such a manner as to improve its filling and to enhance its emptying. Thus, complete filling and complete emptying of the extraction and application space E are guaranteed.

What is claimed is:

1. A fluid dispenser comprising:

a fluid reservoir containing fluid;

a fluid suction chamber of variable volume comprising an extraction and application space that presents a volume that varies between a minimum volume when the suction chamber presents a minimum volume, and a maximum volume when the suction chamber presents a maximum volume;

a dip tube that connects the reservoir to the suction chamber at an orifice;

suction means for sucking, during a suction stage, fluid from the reservoir into the chamber through the orifice;

an extractor and applicator member that defines, in part, the suction chamber and the suction means, the extractor and applicator member defining the extraction and application space;

a handle to be gripped by a user; and a stationary stem secured to the handle and a slidable sleeve mounted in slidable manner on the stationary stem so as to form the extraction and application space, wherein the sliding of the slidable sleeve on the stationary stem varies the volume of the extraction and application space; and wherein the sliding of the slidable sleeve over the stationary stem does not involve any resilient driving force.

2. A dispenser according to claim 1, wherein the extraction and application space includes an open applicator end that communicates with the remainder of the suction chamber, and a closed end, the open and closed ends being movable relative to each other.

3. A dispenser according to claim 1, wherein the slidable sleeve forms an open applicator end of the extraction and application space, and the stationary stem forms a closed end of the extraction and application space.

4. A dispenser according to claim 1, wherein the slidable sleeve also slides in a stationary lip that is secured to the reservoir so as to define the suction means.

5. A dispenser according to claim 1, wherein the slidable sleeve slides over the stationary stem with friction forces that are less than the friction forces of the suction means.

6. A dispenser according to claim 1, wherein the slidable sleeve is in abutment against the stationary stem when the extraction and application space presents a maximum volume.

7. A dispenser according to claim 1, wherein the slidable sleeve is in abutment against at least one of the stationary stem or the handle when the extraction and application space presents a minimum volume.

8. A dispenser according to claim 1, wherein the slidable sleeve is engaged around the stationary stem before the stationary stem is connected in stationary manner to the handle.

9. A dispenser according to claim 1, wherein the suction chamber is open to the outside when the extractor and applicator member is separated from the reservoir.

10. A dispenser according to claim 1, wherein the suction chamber comprises a cylinder to which the dip tube is connected, the cylinder being provided with a leaktight sliding lip for co-operating with the extractor and applicator member so as to form the suction means.

11. A fluid dispenser comprising:

a fluid reservoir containing fluid;

a fluid suction chamber of variable volume comprising an extraction and application space that presents a volume that varies between a minimum volume and a maximum volume;

a dip tube that connects the reservoir to the suction chamber at an orifice;

a piston mechanism to extract, during a suction stage, fluid from the reservoir into the chamber through the orifice; and an extractor and applicator member-that defines, in part, the suction chamber and the piston mechanism, the extractor and applicator member defining the extraction and application space;

a handle for being gripped by a user; and a stationary stem secured to the handle and a slidable sleeve mounted in slidable manner on the stationary stem so as to form the extraction and application space of variable volume; and wherein the extraction and application space includes an open applicator end that communicates with the remainder of the suction chamber, and a closed end, the open and closed ends being movable relative to each other.

12. A fluid dispenser comprising:

a fluid reservoir containing fluid;

a fluid suction chamber of variable volume comprising an extraction and application space that presents a volume that varies between a minimum volume and a maximum volume;

a dip tube that connects the reservoir to the suction chamber at an orifice;

suction means for sucking, during a suction stage, fluid from the reservoir into the suction chamber through the orifice;

an extractor and applicator member-that defines, in part, the suction chamber and the suction means, the extractor and applicator member defining the extraction and application space;

a handle for being gripped by a user; and a stationary stem secured to the handle and a slidable sleeve mounted in slidable manner on the stationary stem so as to form the extraction and application space;

wherein the sliding of the slidable sleeve on the stationary stem varies the volume of the extraction and application space.

13. The dispenser according to claim 12, wherein, when the extractor and applicator member is separated from the reservoir, the fluid contained in the extraction and application space can be discharged by the user by sliding the slidable sleeve on the stationary stem to reduce the volume of the extraction and application space, thereby forcing discharge of the fluid from the extraction and application space.

* * * * *